United States Patent [19]

Butler et al.

[11] Patent Number: 4,928,746

[45] Date of Patent: May 29, 1990

[54] MOULDS FOR METAL CASTING AND SLEEVES CONTAINING FILTERS FOR USE THEREIN

[75] Inventors: David R. Butler, Lichfield; George Snow, Worcester; Philip Sandford, Birmingham; Max G. Neu, Lichfield, all of England; Jean P. Villani, Charleville Mezieres, France; Alain Teyssedre, Charleville Mezieres, France; Roland Lenoir, Flize, France

[73] Assignee: Foseco International Limited, Birmingham, England

[21] Appl. No.: 298,049

[22] Filed: Jan. 18, 1989

[30] Foreign Application Priority Data

| | | | |
|---|---|---|---|
| Jan. 30, 1988 | [GB] | United Kingdom | 8802082 |
| Jan. 30, 1988 | [GB] | United Kingdom | 8802083 |
| Jul. 30, 1988 | [GB] | United Kingdom | 8818186 |
| Jul. 30, 1988 | [GB] | United Kingdom | 8818229 |

[51] Int. Cl.[5] ..... B22C 9/08

[52] U.S. Cl. ..... 164/362; 164/134; 164/358

[58] Field of Search ..... 164/358, 361, 362, 349, 164/134, 359, 360

[56] References Cited

U.S. PATENT DOCUMENTS

| | | | |
|---|---|---|---|
| 1,657,952 | 1/1928 | Zoda . | |
| 2,150,510 | 3/1939 | LeJeune | 164/134 X |
| 3,433,293 | 3/1969 | Ponzar . | |
| 3,893,917 | 7/1975 | Pryor et al. | 164/134 X |
| 4,154,289 | 5/1979 | Jeanneret . | |
| 4,469,161 | 9/1984 | Higginbotham et al. | 164/358 X |
| 4,574,869 | 3/1986 | Trinkl et al. | 164/349 X |
| 4,591,383 | 5/1986 | McGarry et al. . | |
| 4,697,632 | 10/1987 | Lirones . | |
| 4,708,326 | 11/1987 | Brockmeyer et al. | 222/591 X |

FOREIGN PATENT DOCUMENTS

| | | | |
|---|---|---|---|
| 452438 | 10/1972 | Australia . | |
| 1918578 | 10/1969 | Fed. Rep. of Germany . | |
| 3340417 | 5/1985 | Fed. Rep. of Germany | 164/134 |
| 62-21458 | 1/1987 | Japan | 164/134 |
| 62-89560 | 4/1987 | Japan | 164/134 |
| 1138749 | 1/1969 | United Kingdom . | |
| 1464117 | 2/1977 | United Kingdom . | |
| 8711468.2 | 10/1987 | United Kingdom . | |

*Primary Examiner*—Nicholas P. Godici
*Assistant Examiner*—J. Reed Batten, Jr.
*Attorney, Agent, or Firm*—Nixon & Vanderhye

[57] ABSTRACT

A mould (61) for metal casting has a mould cavity (62) and a sprue (63) communicating directly with the mould cavity (62) and located in the sprue (63) a sleeve (64) of refractory material having a cellular ceramic filter (65) fixed therein. The mould, which has no running system apart from the sprue, may be a sand mould or a metal die for producing castings by gravity or low pressure diecasting. The cellular ceramic filter may be a honeycomb type of structure having cells which extend between two outer surfaces of the filter or a structure having interconnecting cells such as a ceramic foam.

40 Claims, 6 Drawing Sheets

MOULDS FOR METAL CASTING AND SLEEVES CONTAINING FILTERS FOR USE THEREIN

This invention relates to moulds for metal casting and sleeves containing filters for use therein.

Moulds such as sand moulds or metal dies for casting molten metal, usually have a mould cavity for producing the desired casting and a running system, usually consisting of a sprue, one or more runner bars and one or more ingates, and possibly one or more feeder cavities located above or at the side of the mould cavity. During solidification cast metals undergo a reduction in their volume. For this reason, in the casting of molten metals into moulds it is usually necessary to employ feeder heads located above or at the side of the castings in order to compensate for the shrinkage which occurs when the castings solidify. It is common practice to surround a feeder head with an exothermic and/or thermally insulated feeder sleeve in order to retain the feeder head metal in the molten state for as long as possible and thereby to improve the feeding effect and to enable the feeder head volume to be reduced to a minimum.

The running system connects the point of entry of molten metal into the mould with the mould cavity and ensures not only that the mould cavity is filled with molten metal satisfactorily but also that the molten metal flows into the mould cavity without turbulence. If molten metal flows into a mould in a turbulent manner, splashing can occur, air can be entrapped in the metal thus leading to porosity in the casting and when casting readily oxidisable metals such as aluminium to oxidation of the metal and the production of oxide inclusions in the casting. Use of a running system entails casting more metal than is needed for producing a particular casting itself and it is not uncommon for the total weight of a casting running system to be up to about 50% of the total weight of the metal casting.

It has now been found that the need to use a running system can be substantially or completely eliminated by inserting in a mould at the point of entry of molten metal into the mould cavity, a sleeve of refractory material having a ceramic foam filter fixed inside the sleeve.

According to the present invention there is provided a mould for metal casting comprising a mould cavity and a sprue communicating directly with the mould cavity and having located in the sprue a sleeve of refractory material having a cellular ceramic filter fixed therein.

According to a further feature of the invention there is provided for use in a mould for casting metal as described above, a sleeve of refractory material having a cellular ceramic filter fixed therein.

As used herein the term sprue means any passage which is used to provide the sole means of entry of molten metal into the mould cavity.

The mould of the invention has no running system apart from the sprue, but in addition to the mould cavity and the sprue the mould may also have one or more feeder cavities.

The mould and the sleeve of the invention may be used for the casting of a variety of non-ferrous metals, for example, aluminium and aluminium alloys, aluminium bronze, magnesium and its alloys, zinc and its alloys and lead and its alloys, or for the casting of ferrous metals such as iron and steel.

The mould may be a sand mould prepared to conventional foundry practice or a permanent mould, such as a metal die, for producing castings by gravity diecasting or by low pressure diecasting.

The material from which the sleeve is made must be sufficiently refractory to withstand the temperature of the metal to be cast in the mould. Suitable materials include metals, ceramic materials, bonded particulate refractory materials such as silica sand and bonded refractory heat-insulating materials containing refractory fibres. For some applications the sleeve may also contain exothermic materials.

Preferably the sleeve is made in bonded refractory heat-insulating material and is made by dewatering on to a suitable former an aqueous slurry containing fibrous material and a binder and optionally particulate material removing the sleeve from the former and then heating the sleeve to remove water and to harden or cure the binder. Such sleeves can be manufactured accurately to close tolerances on both their inner and outer surfaces. This is important because the outer surface must be such that the sleeve fits snugly in the sprue of a die or sand mould without being crushed and without floating of the sleeve occuring when metal is cast into the die or sand mould. Accuracy in the size of the inner surface is important in order to guarantee insertion and location of the filter. Such sleeves are also erosion resistant and this ensures that particles and fibres are not washed from the surface by metal poured into the sleeve and through the filter into the mould cavity.

For ease of manufacture the sleeve will usually be of circular horizontal cross-section but the horizontal cross-section of the sleeve may be for example, oval, oblong or square.

The cellular ceramic filter may be for example a honeycomb type of structure having cells which extend between two outer surfaces of the filter or a structure having interconnecting pores such as a ceramic foam.

Ceramic foam filters are preferred and such filters may be made using a known method of making a ceramic foam, in which an organic foam, usually polyurethane foam, is impregnated with an aqueous slurry of ceramic material containing a binder, the impregnated foam is dried to remove water and the dried impregnated foam is fired to burn off the organic foam to produce a ceramic foam.

The filter is preferably located at or adjacent to the lower end of the sleeeve. The filter may be fixed inside the sleeve by means of an adhesive.

The refractory sleeve may be formed integrally with the filter by forming it around the lateral surface of the filter. During forming it is desirable to cover the open faces of the filter to prevent the material from which the sleeve is formed from entering the pores of the filter and blocking them. When the sleeve and filter are to be used for casting aluminium the cover may conveniently be aluminium foil which in use is immediately melted by molten aluminium poured into the sleeve.

The sleeve containing the filter may also be formed conveniently by inserting the filter in the sleeve during manufacture of the sleeve and deforming the wall of the sleeve around the filter so that the filter is held firmly in position. The sleeve may be made by dewatering on to a former an aqueous slurry containing fibrous refractory material, stripping the sleeve so-formed from the former, inserting a filter in one end of the sleeve so that the filter is located adjacent that end of sleeve, deforming the wall of the sleeve, e.g. by squeezing, around the filter so that the filter is held in place and heating the sleeve so as to harden the binder.

The sleeve may also be formed in two parts and one end of each of the two parts may be fixed to a face of the filter, for example, by means of an adhesive and the lateral surface of the filter sealed to prevent leakage of molten metal in use.

The sleeve may have one or more ledges or shoulders on its inner surface for locating the filter in the desired position.

In a preferred embodiment of the sleeve of the invention the filter is located on one or more ledges at or adjacent the base of the sleeve and is held in position by one or more projections on the inner surface of the sleeve or on the lateral surface of the filter.

Although a plurality of ledges spaced apart around the perimeter of the sleeve at or adjacent its base may be used, it is preferable that the sleeve has a single ledge extending completely around the perimeter. A ledge extending completely around the perimeter of the sleeve not only locates the filter in the desired position but it also prevents metal from bypassing the filter when the sleeve is inserted in the sprue of a mould and has molten metal poured through it.

Although a filter having one or more projections may be used, elongate projections on the inside of the sleeve are preferred so that the filter can be located on the ledge or ledges centrally over the aperture in the base of the sleeve.

The projections on the inner surface of the sleeve may be small knife-edges but they are preferably ribs of a more substantial size. The projections are preferably equally spaced apart around the perimeter of the inner surface of the sleeve and are tapered from bottom to top.

The filter is inserted into the sleeve from the top, located on the ledge or ledges and held in position by the projections. The presence of the projections ensures that small size variations which occur in filters of the same nominal size can be tolerated, because filters of slightly different size can still be held firmly in place.

The combination of the ledge or ledges and the projections allows transportation of the sleeves without the filters being dislodged and prevents the filters from floating when molten metal is poured into moulds in which they are located.

The length of the sleeve may be the same as or similar to the thickness of the filter so that the sleeve is in the form of a ring around the filter. However, it is preferred that the length of the sleeve is appreciably larger than the thickness of the filter, so that the molten metal can be poured into the sleeve, thus avoiding the possibility of metal leaking into the mould cavity around the outside of the sleeve. If desired, to aid filling of the sleeve, the upper end of the sleeve may be flared in the shape of a funnel.

In order to insert and locate the sleeve in the sprue of the mould it is preferred that the outer surface of the sleeve is tapered and that the sprue has a corresponding taper, the direction of taper depending on whether the sleeve is to be inserted in the sprue from above or below. It is also preferred that the outer surface of the sleeve or the mould surface surrounding the sprue has means for holding the sleeve firmly in position once it has been inserted in the sprue. The means may be for example protrusions such as ribs on the lateral surface of the sleeve or protrusions such as ribs formed on the sprue of a sand mould by the use of a recessed former during mould production or in the case of a metal mould or die protrusions such as ribs machined on the mould or die surface surrounding the sprue.

The refractory sleeve is preferably located in the sprue such that the lower end of the sleeve and the filter are not in contact with the casting. This can be achieved for example by incorporating a ledge above the base of the sprue and seating the sleeve on the ledge.

When a casting requiring a feeder is produced using the mould and sleeve of the invention it is possible to locate the sleeve containing the filter in the feeder cavity and to utilise the feeder as the sprue. In such applications it will be usual to use a sleeve which has exothermic and/or heat-insulating properties as well as being refractory in order to achieve satisfactory feeding of the casting.

When the sleeve is required to function as a feeder sleeve in a mould for casting ferrous metal the filter is preferably located at least 0.5 cm, more preferably at least 1 cm from the lower end of the sleeve. Expressed in terms of the overall height of the sleeve the filter is preferably located above the lower end of the sleeve by at least 10% and no more than 75% of the height of the sleeve.

After pouring and as the metal in the mould cavity solidifies and contracts, molten metal is fed from the sleeve cavity through the filter to compensate for the contraction and to produce a sound casting. After solidification the casting is removed from the mould and the sprue/feeder is removed.

In order to make it easy to remove the sprue/feeder a breaker core may be located between the lower end of the sleeve and the mould cavity in accordance with normal practice. The breaker core may be fixed to the base of the sleeve if desired, for example by means of an adhesive or by shaping the breaker core so that part of the breaker core can be push fitted into the sleeve. Alternatively the breaker core may be formed integrally with the sleeve.

By the use of a sleeve of refractory material having a filter therein and a mould according to the invention, having no running system, apart from the sprue, it is possible to produce castings more economically compared with conventional practices of sand casting or gravity diecasting metals because elimination of the running system significantly reduces the weight of metal which must be cast to produce a particular casting and less fettling of the casting is needed.

The construction of a sand mould or the design of a die for gravity diecasting is simplified and both can be made smaller compared to conventional sand moulds or dies. An existing die may be modified to produce a mould according to the invention by blocking off its running system and if necessary, machining the sprue of the die to allow insertion of the sleeve.

Furthermore, metal can be cast at lower melt temperatures and in the case of gravity die-casting, at lower die temperatures.

Castings produced in moulds according to the invention have improved directional solidification characteristics and are substantially free from porosity and inclusions and as a result, have good mechanical properties such as elongation and good machinability and are pressure tight.

The invention is illustrated with reference to the accompanying drawings in which FIGS. 1 to 5 are vertical cross-sections of sleeves according to the invention.

Figure 1:
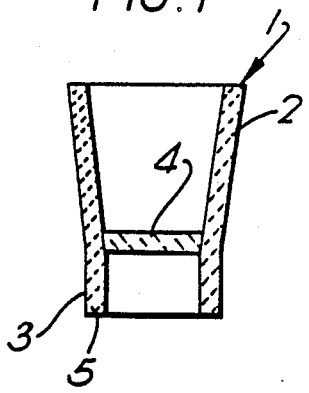

Referring to FIG. 1 a feeder sleeve 1 of circular horizontal cross-section has an upper portion 2 which is funnel shaped and a lower portion 3 which is cylindrical. A filter 4 of ceramic foam having a taper from top to bottom corresponding to the taper of the funnel shaped portion 2 of the sleeve 1 is located at the bottom of the funnel shaped portion 2 and above the lower end 5 of the sleeve by approximately 27% of the overall height of the sleeve 1.

Figure 2:
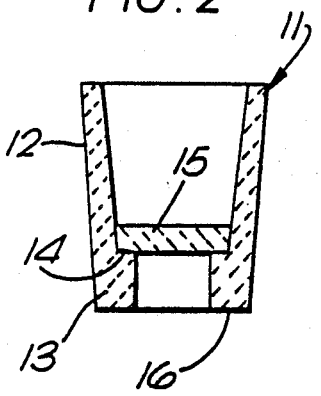

Referring to FIG. 2 a feeder sleeve 11 of circular horizontal cross-section has an upper portion 12 which is funnel shaped and a lower portion 13 whose wall thickness is greater than that of the upper portion so as to produce a ledge 14. A filter 15 of ceramic foam is located on the ledge 14 and above the lower end 16 of the sleeve by approximately 27% of the overall height of the sleeve 11.

Figure 3:
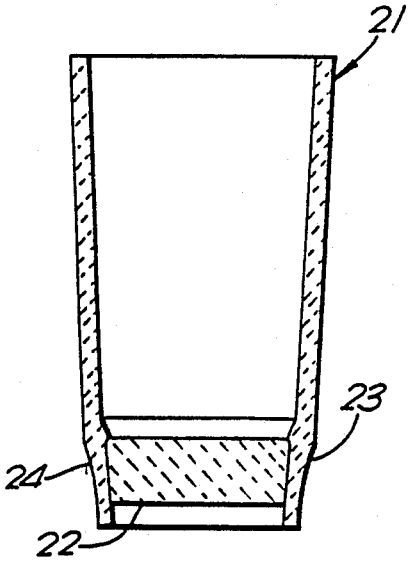

Referring to FIG. 3 a sleeve 21 of circular horizontal cross-section and made from a composition consisting of fibrous refractory material, particulate refractory material and a binder has a ceramic foam filter 22 located adjacent its lower end 23. During manufacture of the sleeve 21, after insertion of the filter 22 and before the binder is hardened, the wall 24 of the tube at the lower end 23 is deformed by a squeezing tool so as to hold the filter 22 in the desired place. Manufacture of the sleeve 21 is then completed by heating the tube to harden the binder.

In use the sleeve 21 is inserted into the sprue of a mould so that the lower end 23 is adjacent the mould cavity and molten metal is poured into the top of the sleeve 21 and passes through the filter 22 into the mould cavity.

Figure 4:
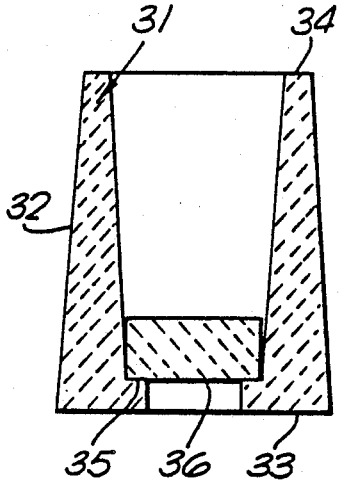

Referring to FIG. 4 a sleeve 31 made in refractory heat-insulating material has an outer lateral surface 32 which tapers from the bottom 33 of the sleeve to the top 34. The inside of the sleeve 31 has a ledge 35 at the bottom 33 of the sleeve 31 on which there is fixed a ceramic foam filter 36. In use the sleeve 31 is inserted into a mould sprue having a taper corresponding to that of the outer lateral surface 32 of the sleeve 31.

Figure 5:
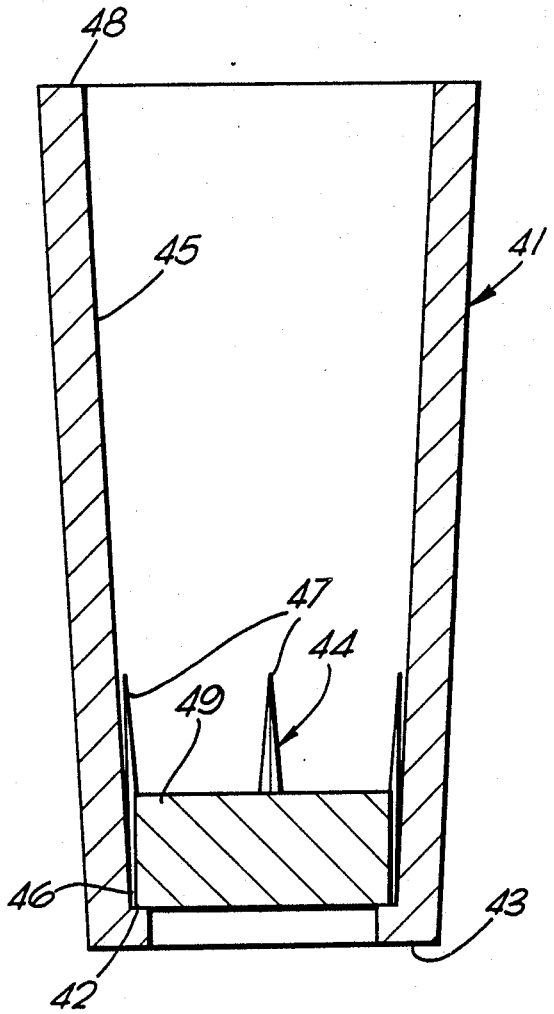
Figure 6:
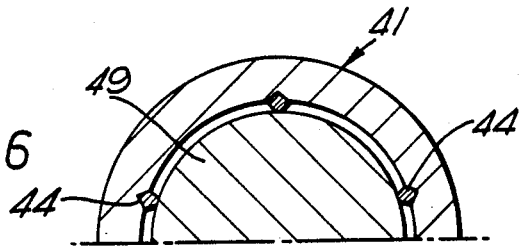
FIG. 6 is a half horizontal cross-section of the sleeve of FIG. 5.

Referring to FIGS. 5 and 6 a sleeve 41 of circular horizontal cross-section and made from refractory material has a ledge 42 at its base 43 extending around the perimeter of the sleeve 41.

The sleeve 41 also has five elongate ribs 44, equally spaced apart around its inner surface 45 adjacent the base 43. The ribs 44 taper from their bottom end 46 to their top end 47 and the sleeve 41 tapers from the top 48 to the base 43. The sleeve 41 contains a ceramic foam filter 49 of circular horizontal cross-section which is inserted in the sleeve 41 at the top 48, located on the ledge 42 and held in place by the ribs 44.

In use the sleeve 41 is inserted into the sprue of a mould and molten metal poured into the top 48 of the sleeve 41, passes through the filter 49 into the mould cavity.

Figure 7:
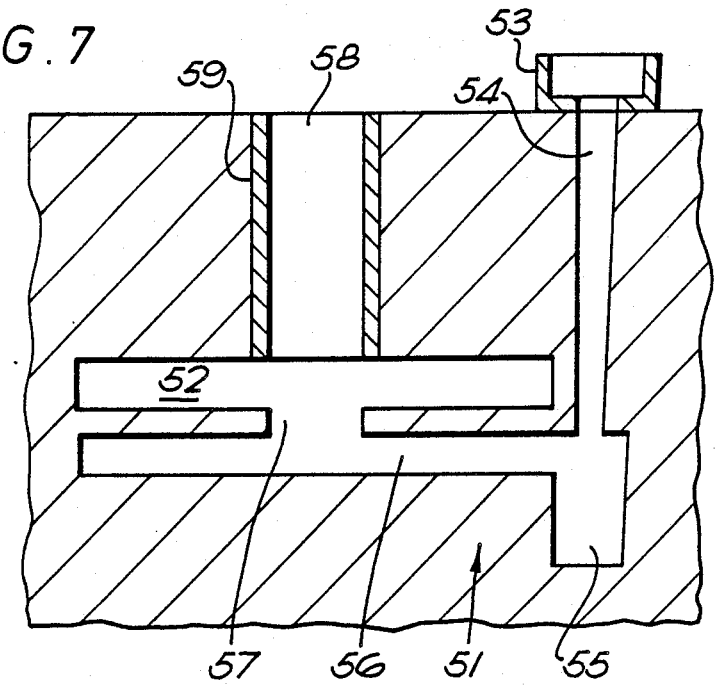
FIG. 7 is a vertical cross-section of a conventional sand mould for producing an aluminium plate casting and FIG. 8 is a vertical cross-section of a sand mould according to the invention for producing the aluminium plate casting of FIG. 7.

Referring to FIG. 7 a sand mould 51 having a mould cavity 52 for producing an aluminium plate casting has a pouring bush 53, a running system comprising a sprue 54, a well 55, a runner bar 56 and an ingate 57 and a feeder cavity 58. The feeder cavity 58 is lined with a cylindrical heat-insulating feeder sleeve 59 made in bonded fibrous and non-fibrous particulate refractory material.

In use molten metal is pouring into the pouring bush 53 and flows through the running system and into the mould cavity 52 and the feeder cavity 58.

Figure 8:
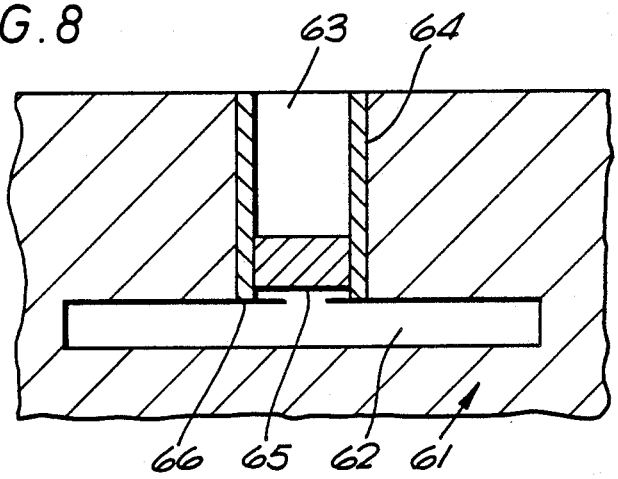

Referring to FIG. 8 a sand mould 61 for producing an aluminium plate casting identical to that to be produced in FIG. 7 has a mould cavity 62 and a sprue 63. The mould has no pouring bush and no running system. The sprue 63 is lined with a refractory heat-insulating sleeve 64 made in bonded fibrous and non-fibrous particulate refractory material and the sleeve 64 has a ceramic foam filter 65 located adjacent its lower end 66. In use molten metal is poured into the sprue 63 and flows through the ceramic foam filter 65 into the mould cavity 62. Pouring ceases when the sprue 63 is full of molten metal.

Moulds of the type shown in FIG. 7 and FIG. 8 were used to produce aluminium plate castings measuring 26 cm×26 cm×2 cm. The total weight of metal cast using the FIG. 7 mould was 5 kg and the total weight of metal cast using the FIG. 8 mould was 3 kg. Using a mould according to the invention therefore gave a saving of 2 kg in the total weight of metal cast.

Figure 9:
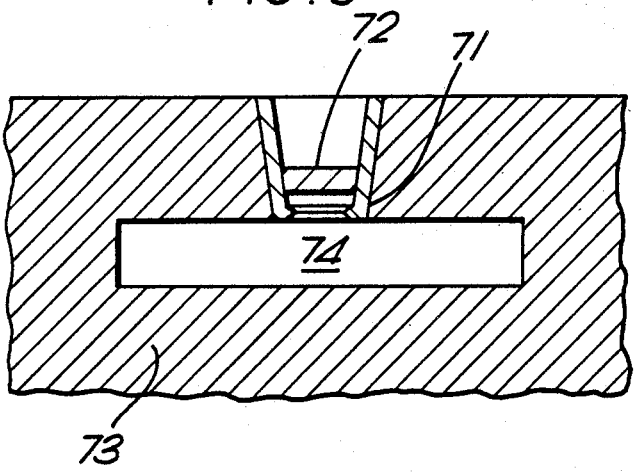
FIGS. 9 and 10 are vertical cross-sections of further embodiments of moulds according to the invention.

Referring to FIG. 9 a cylindrical feeder sleeve 71 tapering from 75 mm inner diameter at the top down to 40 mm inner diameter at the base is fitted with a circular ceramic foam filter 72 of 55 mm diameter held in place by the tapered sleeve wall. The sleeve is located in a sand mould 73 such that the sleeve 71 provides the sole means of entry for metal into mould cavity 74 which is used to produce a plate casting measuring 26×26×3 cm in ductile iron.

When molten iron was poured into the feeder sleeve so as to fill the mould cavity and the sleeve cavity, the total weight of metal poured was 16.3 kg. After the plate casting had solidified the casting was removed from the mould and the feeder was knocked off. 2 mm of the surface of the plate was removed by a skimming operation and the plate was inspected by a dye penetration technique. Very few inclusions were present. For comparison a similar casting was produced in a mould having a sprue, a runner system and a feeder lined with a sleeve of refractory heat-insulating material 75 mm in diameter and 100 mm in height. The total weight of metal cast was 23.15 kg which is 6.85 kg more than the weight cast when using the feeder sleeve of the invention. Furthermore, examination of the plate casting by the dye penetration technique after removal of 2 mm of the surface revealed the presence of a number of inclusions.

Figure 10:
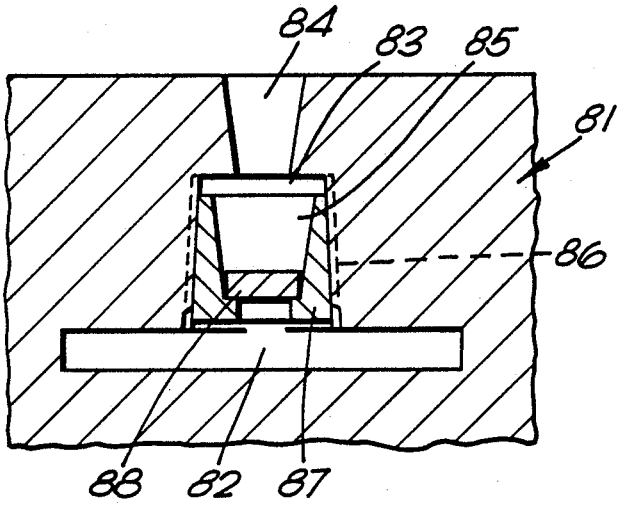

Referring to FIG. 10 a sand mould 81 for producing a plate casting has a mould cavity 82 and a sprue 83 having an upper part 84 and a lower part 85. The lower part 85 is formed by a tapered former which has longitudinally extending recesses in its lateral surface and the recesses form ribs 86 on the surface of the mould material surrounding the lower part 85. A sleeve 87 having a ceramic foam filter 88 fixed therein as shown in FIG. 4 is inserted into the lower part 85 of the sprue 83 and is held firmly in place by the ribs 86. In use molten metal is poured into the upper part 84 of the sprue 83 and the metal passes through the ceramic foam filter 88 into the mould cavity 82.

Figure 11:
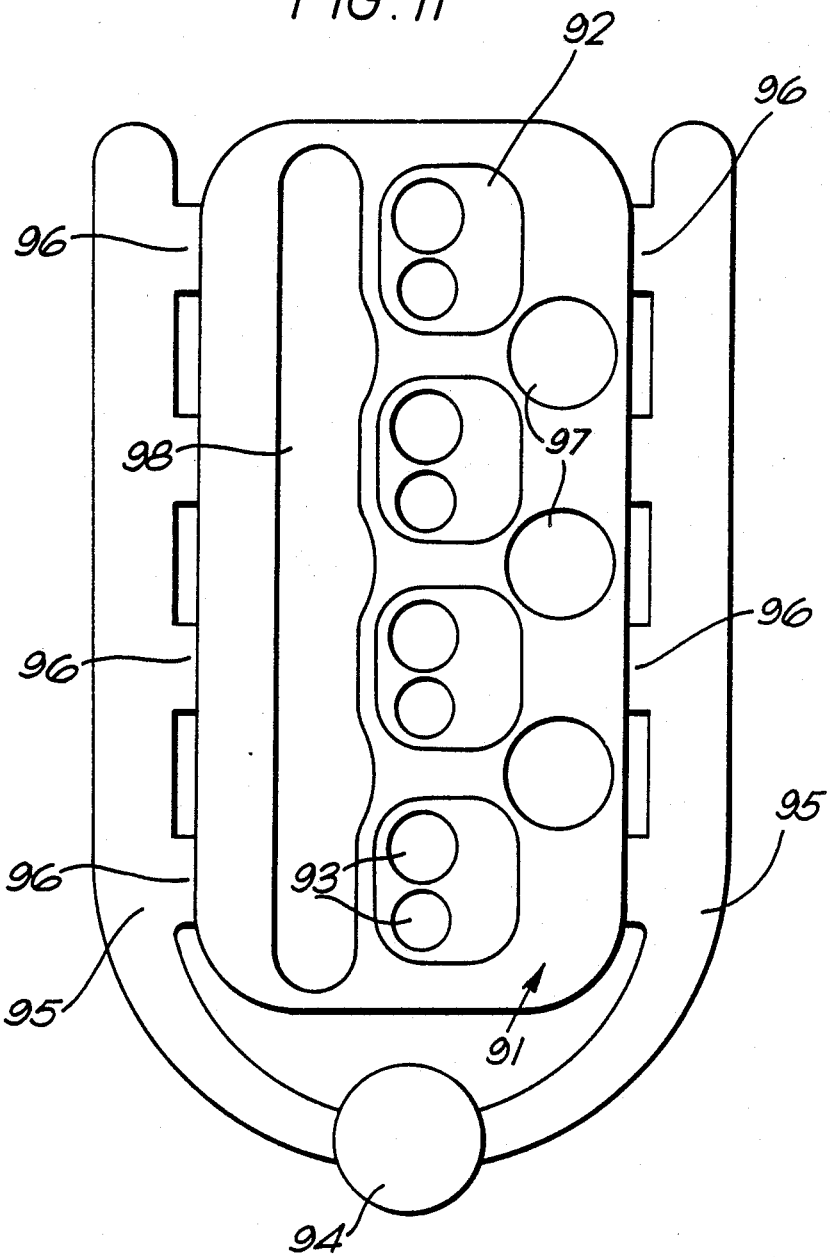
FIG. 11 is a diagrammatic top plan of an aluminium cylinder head casting produced in a conventional metal die by gravity diecasting and FIG. 12 is a diagrammatic top plan of the aluminium cylinder head casting of FIG. 11 produced in a mould according to the invention by gravity diecasting.

Referring to FIG. 11 an aluminium cylinder head casting 91 produced in a gravity die having four cylinders 92 and two valve ports 93 per cylinder has a running system consisting of a sprue 94 connected via runner bars 95 and ingates 96 to the cylinder head and three cylindrical feeders 97 and an elongate feeder 98. The casting 91 is produced by pouring molten aluminium into the sprue 94 so that it flows through the running system into the die cavity and the feeder cavities.

Figure 12:
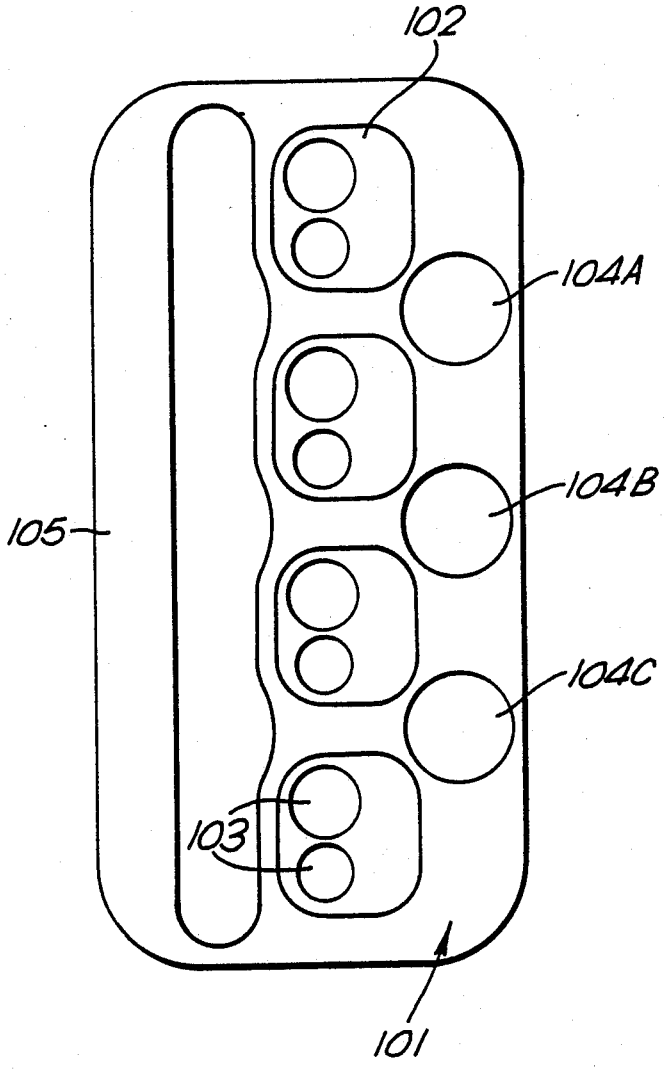

Referring to FIG. 12 an identical aluminium cylinder head casting 101 to that shown in FIG. 11 having four cylinders 102 and two valve ports 103 per cylinder has three cylindrical feeders 104A, 104B, 104C and an elongate feeder 105 but no running system. Prior to production of the casting a refractory sleeve made in bonded fibrous and non-fibrous particulate refractory material and having a ceramic foam filter fixed inside the sleeve at one end was inserted into the cavity of the gravity die for producing the central feeder 104B of the three cylindrical feeders so that the bottom end of the sleeve containing the ceramic foam filter was just above the top of the die cavity. The casting 101 was produced by pouring molten aluminium into the cavity for feeder 104B so that it passed through the sleeve and the filter into the die cavity and the other feeder cavities. The total weight of the casting shown in FIG. 11 was 19.0 kg made up of 10.5 kg for the cylinder head itself, 6.0 kg for the feeders and 2.5 kg for the running system. The total weight of the casting shown in FIG. 12 was 16.5 kg thus resulting in a saving of cast metal of 2.5 kg compared with the FIG. 11 casting.

We claim:

1. A mould for metal casting comprising:

means defining a mould cavity;

means defining one or more sprues communicating directly with said mould cavity and providing the sole means of entry of molten metal into said mould cavity for forming a casting;

a sleeve of refractory material located in each said sprue;

a ceramic foam filter disposed in each said sleeve; and means cooperable between each said filter and said sleeve for fixing said filter in said sleeve at a location spaced from the surface of the casting defined by the mould cavity.

2. A mould according to claim 1 formed of sand.

3. A mould according to claim 1 wherein the mould is a metal die.

4. A mould according to claim 1 wherein one of said sprue and said sleeve has protrusions for holding said sleeve in position.

5. A mould according to claim 1 wherein each said sleeve extends substantially the entire length of said sprue.

6. A mould according to claim 1 wherein the inner end of each said sleeve extends to a location substantially adjacent said mould cavity.

7. A mould according to claim 1 wherein said cooperable means locates said filter spaced from the interior end of said sleeve.

8. A mould according to claim 1 wherein each said sleeve extends substantially the entire length of said sprue, the inner end of each said sleeve extending to a location substantially adjacent said mould cavity, said cooperable means locating said filter spaced from the interior end of said sleeve.

9. A mould according to claim 1 wherein said sleeve has a molten metal receiving opening at one end and a molten metal exit opening at its opposite end for directing metal into said mould cavity, said cooperable means fixing said filter in said sleeve at a location spaced from said sleeve exit opening.

10. A mould according to claim 9 wherein the filter is spaced from said opposite end of the sleeve by at least 10% and no more than 75% of the length of the sleeve.

11. A mould according to claim 9 wherein said sleeve has one or more ledges along an inner surface thereof for locating said filter.

12. A mould according to claim 9 wherein said cooperable means includes an adhesive disposed between said filter and said sleeve.

13. A mould according to claim 9 wherein said sleeve is formed integrally with said filter by forming the sleeve around the lateral surface of the filter.

14. A mould according to claim 9 wherein said filter is inserted in the sleeve during manufacture of the sleeve, the wall of the sleeve being deformed around the filter to hold the filter in position in said sleeve.

15. A mould according to claim 9 wherein said sleeve is formed in two parts, one end of each part being fixed to a face of the filter, the lateral surface of said filter being sealed by each of said parts.

16. A mould according to claim 9 wherein said sleeve has one or more laterally inwardly extending projections on its inner surface for holding said filter in position.

17. A mould according to claim 16 wherein said projections comprise ribs substantially equally spaced apart about the inner surface of the sleeve, said ribs being tapered from bottom to top.

18. A Mould according to claim 9 wherein said filter has one or more laterally outwardly extending projections on its lateral surface for holding said filter in position.

19. A mould according to claim 9 wherein said one end of the sleeve is flared outwardly.

20. A mould according to claim 9 wherein said sleeve includes a breaker core fixed to said opposite end thereof.

21. A mould according to claim 9 wherein said sleeve has a breaker core formed integrally therewith.

22. A mould according to claim 9 wherein said sleeve has laterally outwardly extending protrusions on its outer surface for fixing said sleeve in said mould spruce.

23. A mould according to claim 1 wherein each said sprue has a molten metal exit end at the top of the mould cavity such that the molten metal from said sprue flows directly into said cavity through the top of the mould, said sleeve and said filter disposed in said sleeve being located in said sprue to enable gravity top pouring of the molten metal through the sleeve and sprue into the mould cavity.

24. Apparatus for pouring molten metal through a sprue formed in a mould and into a mould cavity of the mould to form a metal casting, comprising:

a discrete elongated sleeve receivable in the mould sprue and formed of refractory material, said sleeve having a molten metal receiving opening at one end and a molten metal exit opening at its opposite end for directing molten metal substantially directly into the mould cavity;

a ceramic foam filter in said sleeve; and means cooperable between said sleeve and said filter for fixing said filter in said sleeve at a location spaced in the elongated direction of said sleeve from said sleeve exit opening to locate said filter spaced from the mould cavity and enable flow of molten metal into the mould cavity unimpeded by the adjacency of the filter to the mould cavity.

25. Apparatus according to claim 24 wherein said filter has open cells which extend between two outer surfaces of the filter.

26. Apparatus according to claim 24 wherein said filter is located at least 0.5 cm from said opposite end of the sleeve.

27. Apparatus according to claim 26 wherein said filter is located at least 1 cm from said opposite end of the sleeve.

28. Apparatus according to claim 24 wherein said filter is spaced from said opposite end of the sleeve by at least 10% and no more than 75% of the length of the sleeve.

29. Apparatus according to claim 24 wherein said sleeve has one or more ledges along an inner surface thereof for locating said filter.

30. Apparatus according to claim 24 wherein said cooperable means includes an adhesive disposed between said filter and said sleeve.

31. Apparatus according to claim 24 wherein said sleeve is formed integrally with said filter by forming the sleeve around the lateral surface of the filter.

32. Apparatus according to claim 24 wherein said filter is inserted in the sleeve during manufacture of the sleeve, the wall of the sleeve being deformed around the filter to hold the filter in position in said sleeve.

33. Apparatus according to claim 24 wherein said sleeve is formed in two parts, one end of each part being fixed to a face of the filter, the lateral surface of said filter being sealed by each of said parts.

34. Apparatus according to claim 24 wherein said sleeve has one or more laterally inwardly extending projections on its inner surface for holding said filter in position.

35. Apparatus according to claim 34 wherein said projections comprise ribs substantially equally spaced apart about the inner surface of said sleeve, said ribs being tapered from bottom to top.

36. Apparatus according to claim 24 wherein said filter has one or more laterally outwardly extending projections on its lateral surface for holding said filter in position.

37. Apparatus according to claim 24 wherein said one end of the sleeve is flared outwardly.

38. Apparatus according to claim 24 wherein said sleeve includes a breaker core fixed to said opposite end thereof.

39. Apparatus according to claim 24 wherein said sleeve has a breaker core formed integrally therewith.

40. Apparatus according to claim 24 wherein said sleeve has laterally outwardly extending protrusions on its outer surface for fixing said sleeve in the mould sprue.

* * * * *

UNITED STATES PATENT AND TRADEMARK OFFICE

CERTIFICATE OF CORRECTION

PATENT NO. : 4,928,746

DATED : May 29, 1990

INVENTOR(S) : BUTLER ET AL.

It is certified that error appears in the above-identified patent and that said Letters Patent is hereby corrected as shown below:

In the drawings, figures 5-11 should be shown as per attached sheets.

Signed and Sealed this

Sixth Day of August, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,928,746

DATED : May 29, 1990

INVENTOR(S) : BUTLER ET AL.

It is certified that error appears in the above-identified patent and that said Letters Patent is hereby corrected as shown below:

The materials of the sleeves illustrated in Figures 5 and 6 should be shown as being formed of refractory material, as illustrated below:

FIG. 5

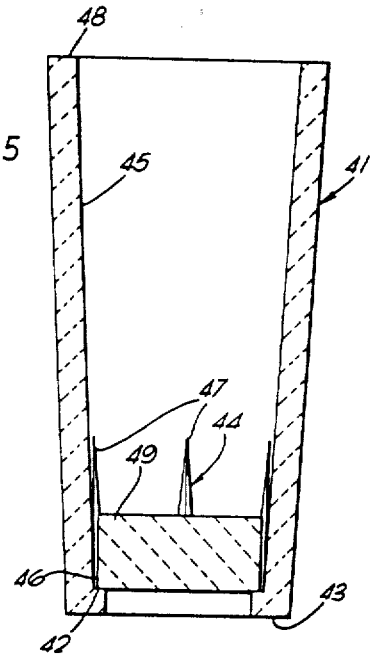

FIG. 6

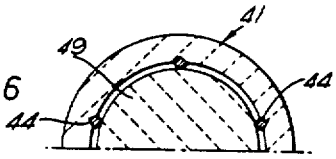

UNITED STATES PATENT AND TRADEMARK OFFICE

CERTIFICATE OF CORRECTION

PATENT NO. : 4,928,746

DATED : May 29, 1990

INVENTOR(S) : BUTLER ET AL.

It is certified that error appears in the above-identified patent and that said Letters Patent is hereby corrected as shown below:

The materials of the moulds illustrated in Figures 7 and 8 should be shown as packed sand rather than as solid metal. The prior art legend is added to Figure 7.

FIG. 7
(PRIOR ART)

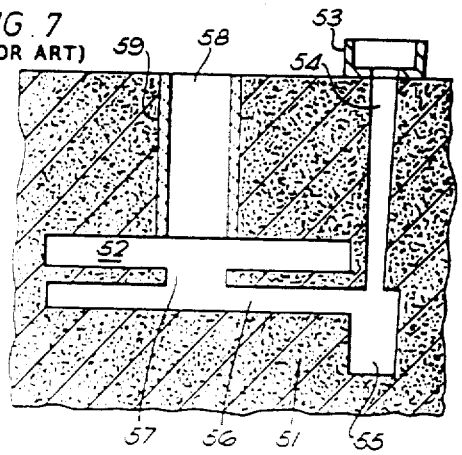

FIG. 8

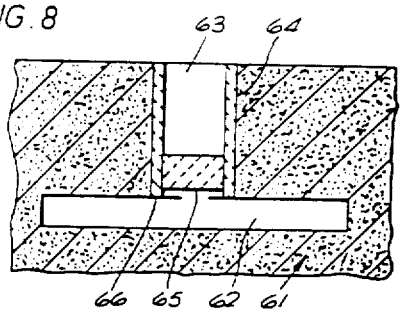

UNITED STATES PATENT AND TRADEMARK OFFICE

CERTIFICATE OF CORRECTION

PATENT NO. : 4,928,746

DATED : May 29, 1990

INVENTOR(S) : BUTLER ET AL.

It is certified that error appears in the above-identified patent and that said Letters Patent is hereby corrected as shown below:

The material of the moulds illustrated in Figures 9 and 10 should be shown as packed sand rather than solid metal.

FIG. 9

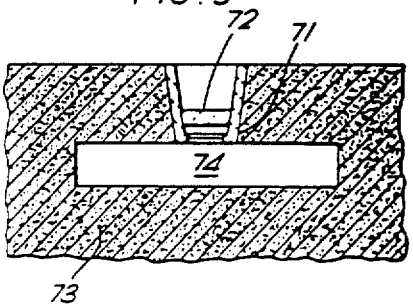

FIG. 10

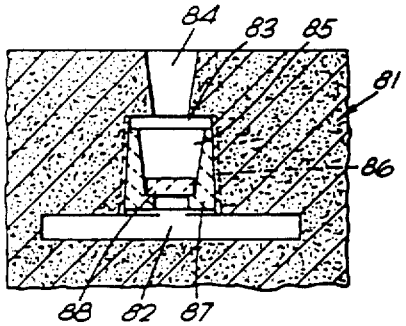

UNITED STATES PATENT AND TRADEMARK OFFICE

CERTIFICATE OF CORRECTION

PATENT NO. : 4,928,746

DATED : May 29, 1990

INVENTOR(S) : BUTLER ET AL.

It is certified that error appears in the above-identified patent and that said Letters Patent is hereby corrected as shown below:

The materials of the moulds illustrated in Figure 11 should be shown as packed sand rather than as solid metal. The prior art legend is added to Figure 11.

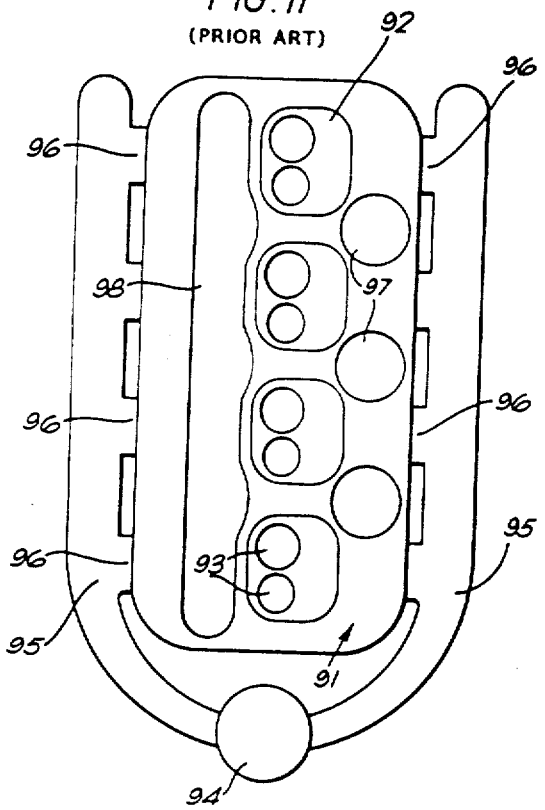

FIG. 11
(PRIOR ART)